US009187209B1

(12) United States Patent
Hanna et al.

(10) Patent No.: US 9,187,209 B1
(45) Date of Patent: Nov. 17, 2015

(54) TAMPER EVIDENT CONTAINER HAVING TEAR TAB AND HINGED LID

(71) Applicant: Highland Packaging Solutions, Inc., Plant City, FL (US)

(72) Inventors: Roger Hanna, Plant City, FL (US); Wade Carter, Auburndale, FL (US)

(73) Assignee: Highland Packaging Solutions, Inc., Plant City, FL (US)

( * ) Notice: Subject to any disclaimer, the term of this patent is extended or adjusted under 35 U.S.C. 154(b) by 293 days.

(21) Appl. No.: 13/935,943

(22) Filed: Jul. 5, 2013

(51) Int. Cl.

| | |
|---|---|
| ***B65D 17/32*** | (2006.01) |
| ***B65D 17/347*** | (2006.01) |
| ***B65D 17/353*** | (2006.01) |
| ***B65D 43/16*** | (2006.01) |
| ***B65D 17/00*** | (2006.01) |

(52) U.S. Cl.
CPC ..... *B65D 17/163* (2013.01)

(58) Field of Classification Search
CPC ..... B65D 2543/00296; B65D 2543/00685; B65D 2543/00796; B65D 2543/00842; B65D 2543/0062; B65D 2543/00194; B65D 2543/00731; B65D 2543/00537; B65D 2543/00101; B65D 2101/0015; B65D 2101/0023; B65D 2101/0092; B65D 43/021; B65D 43/0254; B65D 2101/0038
USPC ..... 215/254; 220/4.21–4.25, 214, 265–280, 220/315–328, 780–795, 810–849
See application file for complete search history.

(56) References Cited

U.S. PATENT DOCUMENTS

| | | | | | |
|---|---|---|---|---|---|
| 3,294,274 | A * | 12/1966 | Spitzberg | 220/803 |
| 4,798,301 | A * | 1/1989 | Bullock et al. | 215/256 |
| 5,129,531 | A * | 7/1992 | Beck et al. | 215/256 |
| 5,219,087 | A * | 6/1993 | Christensson | 220/270 |
| 5,617,968 | A * | 4/1997 | Luburic | 220/276 |
| 5,626,251 | A * | 5/1997 | Luburic et al. | 220/276 |
| 5,695,087 | A * | 12/1997 | Tutton et al. | 220/324 |
| 5,897,011 | A * | 4/1999 | Brilliant et al. | 220/4.23 |
| 5,938,068 | A * | 8/1999 | Atkins et al. | 220/839 |
| 5,960,979 | A * | 10/1999 | Van Den Brink et al. | 220/266 |
| 7,063,230 | B2 * | 6/2006 | Ciccone | 220/792 |
| 7,073,680 | B2 * | 7/2006 | Boback et al. | 220/266 |
| 7,118,003 | B2 * | 10/2006 | Sellari et al. | 220/266 |
| 7,134,567 | B2 * | 11/2006 | Luburic | 220/276 |
| 7,568,589 | B2 * | 8/2009 | Vovan | 220/4.23 |
| 7,631,776 | B2 * | 12/2009 | Vovan et al. | 220/266 |
| 7,712,626 | B2 * | 5/2010 | Vovan | 220/791 |
| 7,946,441 | B2 * | 5/2011 | Habitz et al. | 220/270 |
| 7,992,743 | B2 * | 8/2011 | Vovan | 220/791 |

(Continued)

*Primary Examiner* — Anthony Stashick
*Assistant Examiner* — Ned A Walker
(74) *Attorney, Agent, or Firm* — Nicholas Pfeifer; Ronald E. Smith; Smith & Hopen, P.A.

(57) ABSTRACT

A container having a lid includes a cavity defined by a bottom wall and a first plurality of upstanding sidewalls. A first flange is formed integrally with the first plurality of upstanding sidewalls at their respective uppermost ends and extends outwardly with respect to the cavity. A second plurality of upstanding sidewalls is mounted about the outer periphery of the first flange. A second flange is formed integrally with the second plurality of upstanding sidewalls at their respective uppermost ends and extends outwardly with respect to the cavity. The second flange has a tear tab adapted to be gripped by a user. The tear tab is corner-mounted in a first embodiment and is formed on a leading end of the second flange in a second embodiment. In both embodiments, the tear tab is bordered by perforation lines and clear cut lines and is easily seen if it has been torn.

8 Claims, 7 Drawing Sheets

(56) References Cited

U.S. PATENT DOCUMENTS

| | | | | |
|---|---|---|---|---|
| 8,011,566 | B2 * | 9/2011 | Robertson et al. | 229/125.13 |
| 8,083,089 | B2 * | 12/2011 | Vovan | 220/359.2 |
| 8,127,961 | B2 * | 3/2012 | Vovan | 220/270 |
| 8,251,242 | B2 * | 8/2012 | Vovan | 220/276 |
| 8,322,553 | B2 * | 12/2012 | Rider et al. | 220/203.09 |
| D673,847 | S * | 1/2013 | Barbier | D9/420 |
| 8,381,946 | B2 * | 2/2013 | Everson | 220/839 |
| 8,459,486 | B2 * | 6/2013 | Luburic et al. | 220/276 |
| D685,628 | S * | 7/2013 | Durdon et al. | D9/420 |
| 8,608,008 | B2 * | 12/2013 | Gingras et al. | 220/270 |
| D697,795 | S * | 1/2014 | Garza | D9/425 |
| 8,714,394 | B2 * | 5/2014 | Wulf | 220/326 |
| 8,794,471 | B2 * | 8/2014 | Bontrager et al. | 220/279 |
| 8,839,975 | B2 * | 9/2014 | Luburic | 220/254.3 |
| 8,851,315 | B2 * | 10/2014 | Vovan | 220/359.2 |
| 8,925,755 | B2 * | 1/2015 | Lesquir et al. | 220/266 |
| 9,016,503 | B2 * | 4/2015 | Barbier et al. | 220/270 |
| 2002/0113074 | A1 * | 8/2002 | Baker | 220/835 |
| 2003/0189048 | A1 * | 10/2003 | Luburic | 220/276 |
| 2004/0079757 | A1 * | 4/2004 | Ciccone | 220/836 |
| 2004/0118848 | A1 * | 6/2004 | Marshall | 220/266 |
| 2005/0017007 | A1 * | 1/2005 | Sellari et al. | 220/270 |
| 2005/0184070 | A1 * | 8/2005 | Boback et al. | 220/266 |
| 2006/0144744 | A1 * | 7/2006 | Rodriquez et al. | 206/509 |
| 2006/0175334 | A1 * | 8/2006 | Schwarz | 220/276 |
| 2006/0266750 | A1 * | 11/2006 | Lesquir | 220/276 |
| 2006/0289541 | A1 * | 12/2006 | Boback et al. | 220/266 |
| 2006/0289549 | A1 * | 12/2006 | Vovan | 220/791 |
| 2007/0012710 | A1 * | 1/2007 | Vovan | 220/793 |
| 2007/0045317 | A1 * | 3/2007 | Rosender et al. | 220/266 |
| 2007/0138180 | A1 * | 6/2007 | Vovan | 220/266 |
| 2009/0071927 | A1 * | 3/2009 | Fily et al. | 215/254 |
| 2009/0159607 | A1 * | 6/2009 | Kratzer | 220/849 |
| 2009/0173738 | A1 * | 7/2009 | Golota et al. | 220/265 |
| 2010/0051620 | A1 * | 3/2010 | Parikh et al. | 220/270 |
| 2010/0065567 | A1 * | 3/2010 | Vovan | 220/266 |
| 2010/0084401 | A1 * | 4/2010 | Golota et al. | 220/270 |
| 2010/0102074 | A1 * | 4/2010 | Parikh et al. | 220/810 |
| 2010/0140267 | A1 * | 6/2010 | Sellari et al. | 220/270 |
| 2010/0276422 | A1 * | 11/2010 | Vovan et al. | 220/260 |
| 2011/0031246 | A1 * | 2/2011 | Masse et al. | 220/214 |
| 2011/0036842 | A1 * | 2/2011 | Sellari et al. | 220/315 |
| 2012/0061412 | A1 * | 3/2012 | Vovan | 220/810 |
| 2012/0181280 | A1 * | 7/2012 | Barbier et al. | 220/269 |
| 2013/0020325 | A1 * | 1/2013 | Stone et al. | 220/270 |
| 2013/0306636 | A1 * | 11/2013 | Wulf | 220/259.1 |
| 2013/0313275 | A1 * | 11/2013 | Gingras et al. | 220/833 |
| 2013/0320015 | A1 * | 12/2013 | Dyble et al. | 220/276 |
| 2014/0190969 | A1 * | 7/2014 | Huang | 220/268 |
| 2014/0224803 | A1 * | 8/2014 | Pickering | 220/266 |
| 2014/0224804 | A1 * | 8/2014 | Pickering | 220/270 |
| 2014/0224824 | A1 * | 8/2014 | Pickering | 220/810 |
| 2014/0284346 | A1 * | 9/2014 | McCumber | 220/792 |
| 2015/0060454 | A1 * | 3/2015 | Kowal et al. | 220/269 |

* cited by examiner

TAMPER EVIDENT CONTAINER HAVING TEAR TAB AND HINGED LID

BACKGROUND OF THE INVENTION

1. Field of the Invention

This invention relates, generally, to containers having lids. More particularly, it relates to containers that provide a visual indication to an ultimate consumer as to whether or not the container has been opened subsequent to its shipment from a packing facility.

2. Description of the Prior Art

Strawberries, blueberries, and other such fruits are commonly packed in clear plastic containers having hingedly attached or removable lids. Brussel sprouts, grape or cherry tomatoes and the like may also be sold in such containers. The containers are also suitable for nuts, trail mixes or deli items such as potato salads and the like. The containers are generally of parallelepiped construction and usually have rounded or beveled corners.

As a general rule, the lid is held in a closed position by a press fit within the rim of the container. The resulting friction prevents the lid from easily opening during container handling at the packaging facility, transporting of the filled container to its destination, and container handling at the grocery store. The consumer must intentionally exert a separation force in order to open the container, i.e., it will not open inadvertently.

However, grocery store customers have been observed opening such containers prior to purchase, taking a few (or more) morsels therefrom, and re-closing the lid. Such customers then purchase an unopened container or leave the scene of the pilfering with no purchase made.

Accordingly, the container industry has developed several container structures that indicate whether or not a container has been opened after its initial filling and closing.

One such structure includes a tab having a bottom half secured to the container base and a top half secured to the container lid. The top half is bordered by perforations so that it separates from the lid when the lid is rotated about its hinge to open the container. This creates a tab-shaped recess in the lid and indicates that the lid has been opened.

The problem with this design is that the recess is best seen when the container is open and if the container is open, no recess formed in the lid is needed to indicate that the lid has been opened. The pilferer simply re-closes the lid and the tab re-aligns with the recess. It requires careful inspection to determine whether or not the perforations that border the tab have been ruptured and most consumers do not perform such careful inspections.

Another design includes a tab that interconnects the base and the lid of the container so that a removed tab indicates that the container has been opened. The primary problem with that design is that an experienced pilferer can leave the tab in place and pry the lid open; the tab remains in place when the pilfering is completed and the lid is re-closed.

Thus there is a need for a tamper-indicating structure that is obvious even to a casual purchaser if the container has been opened and which makes it exceedingly difficult to open the container without removing a tab.

However, in view of the art considered as a whole at the time the present invention was made, it was not obvious to those of ordinary skill in the art how the needed structure could be provided.

SUMMARY OF THE INVENTION

The long-standing but heretofore unfulfilled need for a container structure that indicates whether or not the container lid has been opened after it has been closed is now met by a new, useful, and non-obvious invention.

The inventive structure includes a tab-protected container having a lid hingedly secured thereto. The leading end of the container is defined as the tab end and the trailing end is defined as the end to which the lid is hingedly secured.

The tab has a "Tear here" instruction imprinted thereon. A person desiring to enter the container without following those instructions will attempt to enter the container at the hinged end which is opposite the tab end as aforesaid.

The container base includes a cavity defined in part by a bottom wall having a first plurality of upstanding sidewalls mounted about the periphery of the bottom wall and projecting upwardly therefrom a first predetermined distance.

A first flange is formed integrally with the first plurality of upstanding sidewalls at the respective uppermost ends thereof and extends outwardly with respect to the cavity. This first flange underlies the rim of the lid when the lid is press fit onto the container base to close the container.

A second plurality of upstanding sidewalls is mounted about the outer periphery of the first flange and projects upwardly therefrom a second predetermined distance. The height of the second plurality of upstanding sidewalls is about equal to the height or thickness of the lid.

A second flange is formed integrally with the second plurality of upstanding sidewalls at the respective uppermost ends thereof and said second flange extends outwardly with respect to the cavity and in parallel relation to the first flange.

The second flange circumscribes the second plurality of sidewalls with the exception of a gap of predetermined extent formed in the trailing end of the second flange. This gap receives a hinge plate formed integrally with the lid and defeats attempts to open the lid without first tearing the tear tab.

More particularly, the hinge plate has a greater extent than the gap so that the opposite ends of the hinge plate snap-fittingly engage the opposite ends of the gap and underlie the second flange. Prying the container open while leaving the tear tab in place results in separation of the lid from the container base because the opposite ends of the hinge plate pop out from under the flange in response to such prying action.

The hinge plate is formed of a flexible and resilient material and lies in a flat plane when in repose. When the container is assembled, the hinge plate has a first position in overlying, abutting relation to the second flange in registration with the gap. The hinge plate cannot fall through the gap because the extent of the hinge plate exceeds the extent of the gap as aforesaid.

The hinge plate is bowed in response to application of an external force against the center of the hinge plate when the hinge plate is in said first position, the external force being in the direction of the gap.

The opposite ends of the hinge enter the gap when the hinge plate is in said bowed configuration. The flexibility and resilience of the hinge plate returns the hinge plate to its unbowed position upon removal of the external force, said removal occurring after the opposite ends of the hinge plate have passed through the gap. The opposite ends of the hinge plate lie under the opposite ends of the gap formed in the second flange when the hinge plate returns to its flat position of repose. Prying the lid open without removal of the tear tab thus results in separation of the lid from the container base as the hinge plate returns to its position above the gap.

The lid has at least one beveled corner where adjacent sidewalls are interconnected to one another by a chord. Preferably, all of the corners of the lid are beveled, i.e., sidewalls that form a corner are interconnected by a chord.

The second flange of the container has at least one ninety degree corner that is adjacent a beveled corner of the lid when the lid is closed. That ninety degree corner extends beyond the beveled corner of the lid and is adapted to be gripped by a consumer. It is a tear tab and is provided with a "Tear Here" indicia to communicate that fact to the consumer.

A first straight perforation line is formed in the second flange on a first side of the tear tab at a ninety degree angle transversely disposed relative to a first longitudinal extent of the second flange.

A second straight perforation line is formed in the second flange on a second side of the tear tab at a ninety degree angle transversely disposed relative to a second longitudinal extent of the second flange.

The first and second longitudinal extents of the second flange are disposed at a ninety degree angle to one another and meet one another at the ninety degree corner.

The first and second perforation lines are equidistantly spaced apart from one another on opposite sides of the tear tab.

A first straight clean cut line extends from an innermost end of the first straight perforation line. It is formed in a first sidewall of the second plurality of sidewalls and extends from the second flange to the first flange.

A second straight clean cut line extends from an innermost end of the second straight perforation line. It is formed in a second sidewall of the second plurality of sidewalls and extends from the second flange to the first flange in parallel relation to the first straight clean cut line.

A third straight perforation line is formed in the first flange. It extends from a lowermost end of the first straight clean cut line in transverse relation to a first longitudinal extent of the first flange and terminates at a first predetermined point between an outer edge of the first flange and an inner edge of the first flange.

A fourth straight perforation line is also formed in the first flange. It extends from a lowermost end of the second straight clean cut line in transverse relation to a second longitudinal extent of the first flange and terminates at a second predetermined point between an outer edge of the first flange and an inner edge of the first flange.

A first arcuate perforation line is formed in the first flange. It extends from the first predetermined point to a third predetermined point formed in the first longitudinal extent of the first flange.

A second arcuate perforation line is also formed in the first flange. It extends from the second predetermined point to a fourth predetermined point formed in the second longitudinal extent of the first flange.

Finally, a fifth straight perforation line extends in interconnecting relation between the third and fourth predetermined points. The fifth straight perforation line can also be provided as a non-perforated straight folding line.

Accordingly, lifting or depressing the tear tab breaks the second flange along the first and second straight perforation lines, allows separation of the first and second sidewalls along the first and second straight clean cut lines, partially breaks the first flange along the third and fourth straight perforation lines, partially breaks the first flange along the first and second arcuate lines, and folds the tear tab away from the container along the fifth straight perforation or folding line.

In a second embodiment, the second flange has a rectangular tear tab of predetermined extent that projects outwardly from the second flange in coplanar relation therewith so that the tear tab is easily visible and is also adapted to be gripped by a user. The rectangular tear tab is bordered by perforation lines, clean cut lines, and a perforated or non-perforated folding line much like the tear tab of the first embodiment.

The primary object of the invention is to enable a consumer to easily determine if a container has been opened prior to the consumer's purchase thereof.

A closely related object is to facilitate opening of the container by a consumer.

Another important object is to defeat facile opening of the container while circumventing the tear tab and the hinge.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENTS

Figure 1:
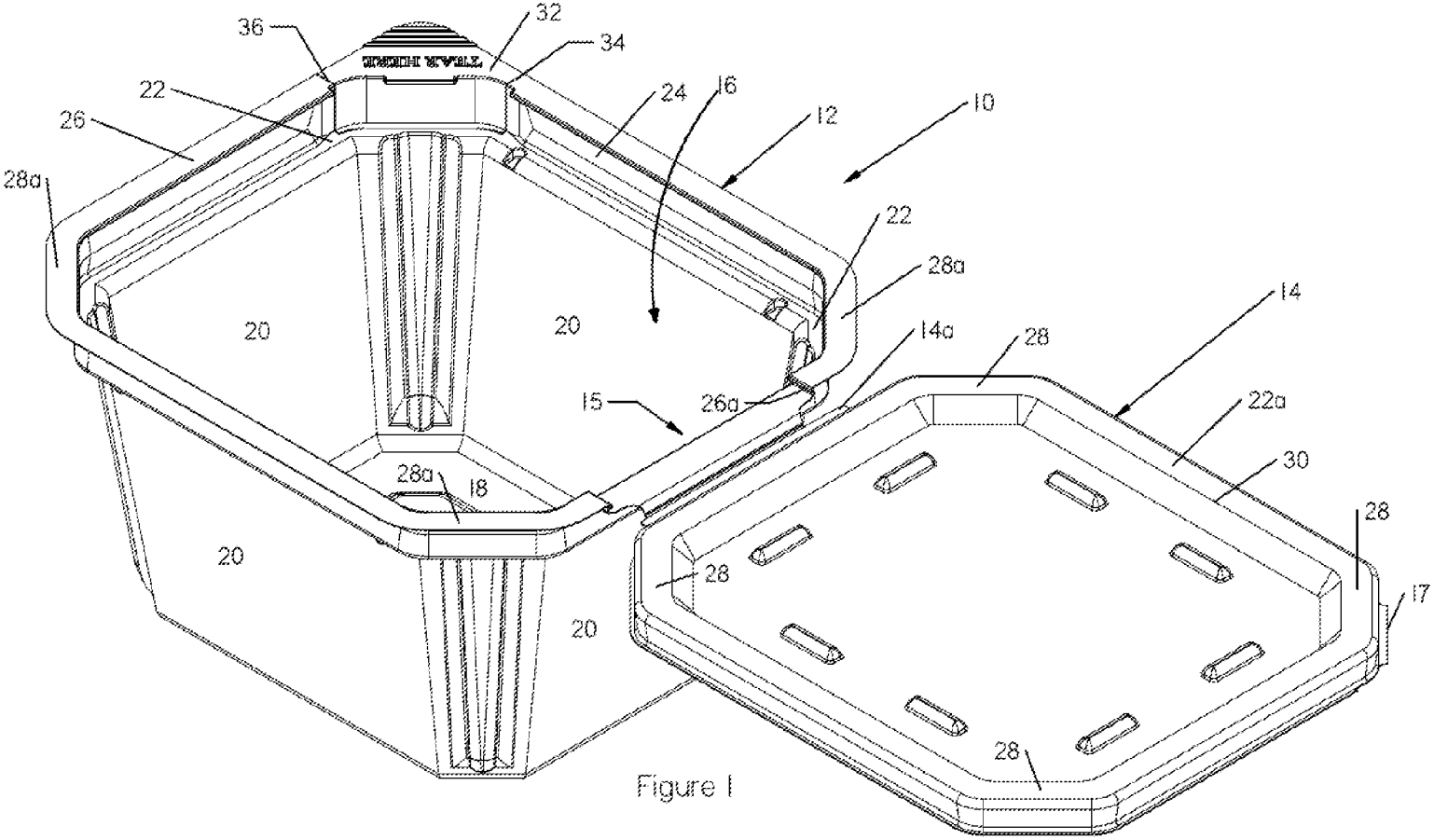
FIG. 1 is a perspective view of a first embodiment of the novel structure depicting the lid in an open configuration.

FIG. 1 depicts a first illustrative embodiment of the novel structure which is denoted as a whole by the reference numeral 10.

The inventive structure includes container 12 having lid 14 hingedly secured thereto as at 15.

Container 12 includes cavity 16 defined in part by bottom wall 18 having a first plurality of upstanding sidewalls, collectively denoted 20, mounted about the periphery of bottom wall 18 and projecting upwardly therefrom a first predetermined distance.

First flange 22 is formed integrally with the first plurality of upstanding sidewalls 20 at the respective uppermost ends thereof and extends outwardly with respect to cavity 16. First flange 22 may also be understood as being the flat top surfaces of each sidewall 20. Note that lid 14 includes ridge 22*a*. This ridge overlies and abuts first flange 22 when lid 14 is in its container-closing configuration.

A second plurality of upstanding but very truncate sidewalls, collectively denoted 24, is mounted about the outer periphery of first flange 22 and projects upwardly therefrom a second predetermined distance. That second predetermined distance is about the thickness of lid 14. Accordingly, lid 14 is substantially flush with the rim of container 12 when said container is closed, and said lid is press fit into the opening bordered by said short sidewalls 24. This structure prevents facile grasping of lid 14 in order to separate lid 14 from container 12.

Second sidewalls 24 may be thought of as continuations of first sidewalls 20, interrupted by step/first flange 22.

Second flange 26 is formed integrally with and circumscribes the second plurality of upstanding sidewalls 24 at the respective uppermost ends thereof and extends outwardly with respect to cavity 16 and in parallel relation to first flange 22.

A gap having opposite ends denoted 26*a*, 26*a* is formed in second flange 26 in the trailing end of container base 12 where lid 14 is hingedly secured thereto.

Lid 14 has at least one beveled corner 28 where adjacent sidewalls are interconnected to one another. Preferably, all of the corners of the lid are beveled, i.e., all of the sidewalls that form a corner 28 are beveled as depicted.

Container 12 has three matching beveled corners 28*a* in this embodiment and one corner 32 that is unbeveled. Corner 32 is a ninety degree corner and provides the function of a tear tab. Tear tab 32 is formed in the leading end of container 12; the end of the container having hinge 15 formed therein is deemed the trailing end of the container as aforesaid. Thus it is understood that tear tab 32 could be formed in either one of the two corners of the leading end of container 10.

Tear tab 32 is adjacent a beveled corner 28 of lid 14 when lid 14 is closed and said tear tab 32 is exposed to view and may be gripped by a consumer. A "Tear Here" indicia is imprinted upon it to inform the customer of its utility. Lid-lifting tab 17 at the lower right corner of FIG. 1 is adjacent tear tab 32 when lid 14 is closed.

A first straight perforation line 34 is formed in second flange 26 on a first side of tear tab 32 at a ninety degree angle, i.e., straight perforation line 34 is transversely disposed relative to a first longitudinal extent of second flange 26.

A second straight perforation line 36 is formed in second flange 26 on a second side of tear tab 32 at a ninety degree angle, i.e., second straight perforation line 36 is transversely disposed relative to a second longitudinal extent of second flange 26.

The first and second longitudinal extents of second flange 26 are disposed at a ninety degree angle to one another and meet one another at ninety degree corner 32.

First and second straight perforation lines 34 and 36 are equidistantly spaced apart from one another on opposite sides of tear tab 32.

Figure 2:
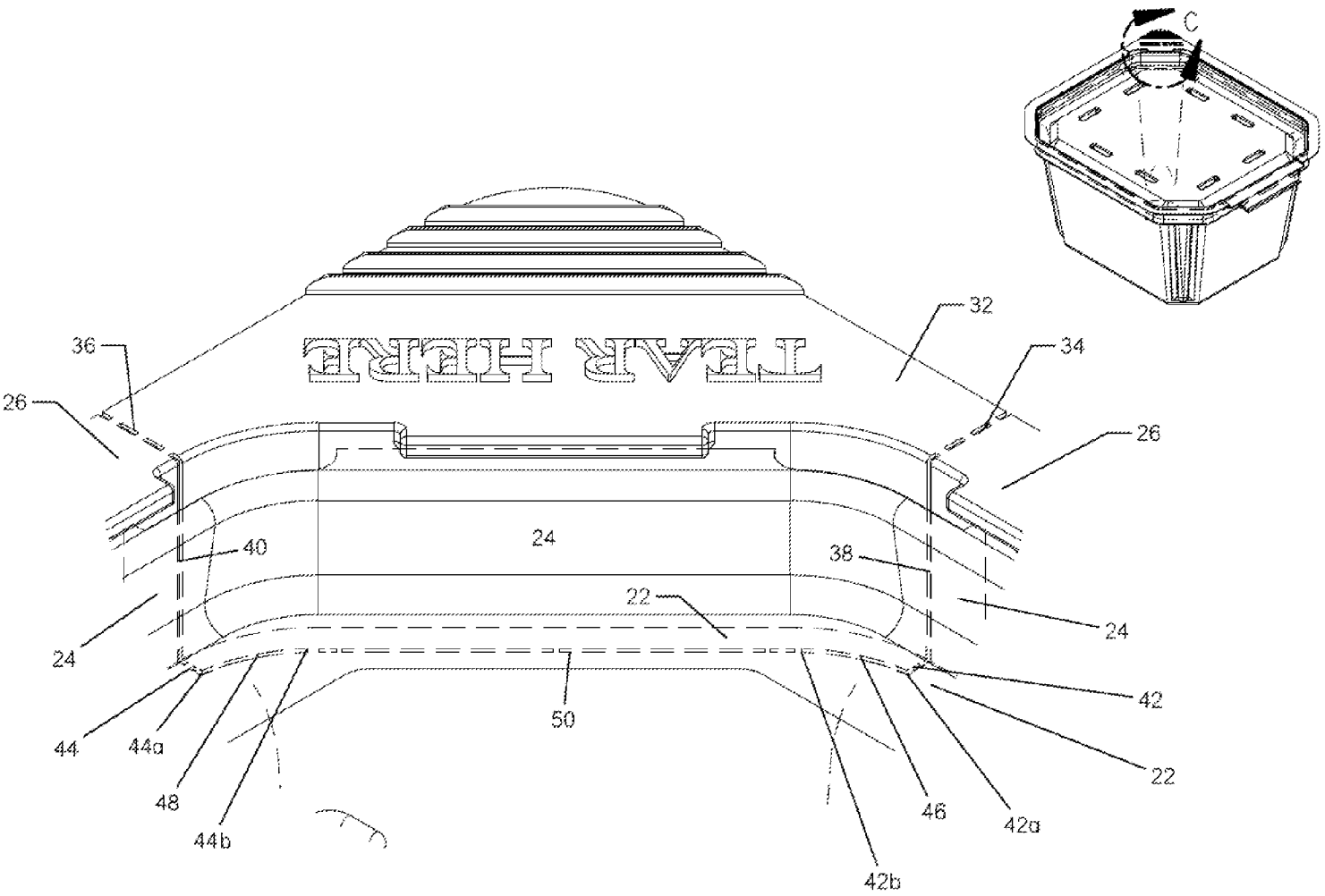
FIG. 2 is a detailed perspective view of the tear tab of the first embodiment when the lid is closed.

Although first and second straight perforation lines 34 and 36 are easily seen in FIG. 1, the remaining lines of this first embodiment are best seen in FIG. 2.

First straight clean cut line 38 extends from an innermost end of first straight perforation line 34. It is formed in a first sidewall 24 of the second plurality of sidewalls and extends from second flange 26 to first flange 22.

Second straight clean cut line 40 extends from an innermost end of second straight perforation line 36. It is formed in a second sidewall of the second plurality of sidewalls and extends from second flange 26 to first flange 22 in parallel relation to first straight clean cut line 38.

Third straight perforation line 42 is formed in first flange 22. It extends from a lowermost end of first straight clean cut line 38 in transverse relation to a first longitudinal extent of first flange 22 and terminates at a first predetermined point 42*a* between an outer edge of first flange 22 and an inner edge of said first flange.

Fourth straight perforation line 44 is also formed in first flange 22. It extends from a lowermost end of second straight clean cut line 40 in transverse relation to a second longitudinal extent of first flange 22 and terminates at a second predetermined point 44*a* between an outer edge of first flange 22 and an inner edge of said first flange.

First arcuate perforation line 46 is formed in first flange 22 as well. It extends from first predetermined point 42*a* to third predetermined point 42*b*.

Second arcuate perforation line 48 is also formed in first flange 22. It extends from second predetermined point 44*a* to fourth predetermined point 44*b*.

Finally, fifth straight perforation line 50 extends in interconnecting relation between the third and fourth predetermined points 42*b* and 44*b*, respectively. In an alternative embodiment, said fifth line 50 may be provided in the form of a non-perforated straight folding line.

Accordingly, lifting or depressing tear tab 32 breaks second flange 26 along first and second straight perforation lines 34 and 36, respectively, allows separation of second sidewalls 24 along first and second straight clean cut lines 38 and 40, respectively, partially breaks first flange 22 along third and fourth straight perforation lines 42 and 44 respectively, partially breaks first flange 22 along first and second arcuate lines 46 and 48, respectively, and folds tear tab 32 away from container 12 along fifth straight perforation or folding line 50.

Figure 3:
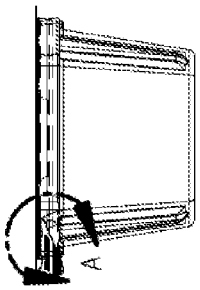
FIG. 3 is a detailed perspective view depicting the tab of the first embodiment when the perforation lines have been broken and the container lid is closed.
Figure 3:
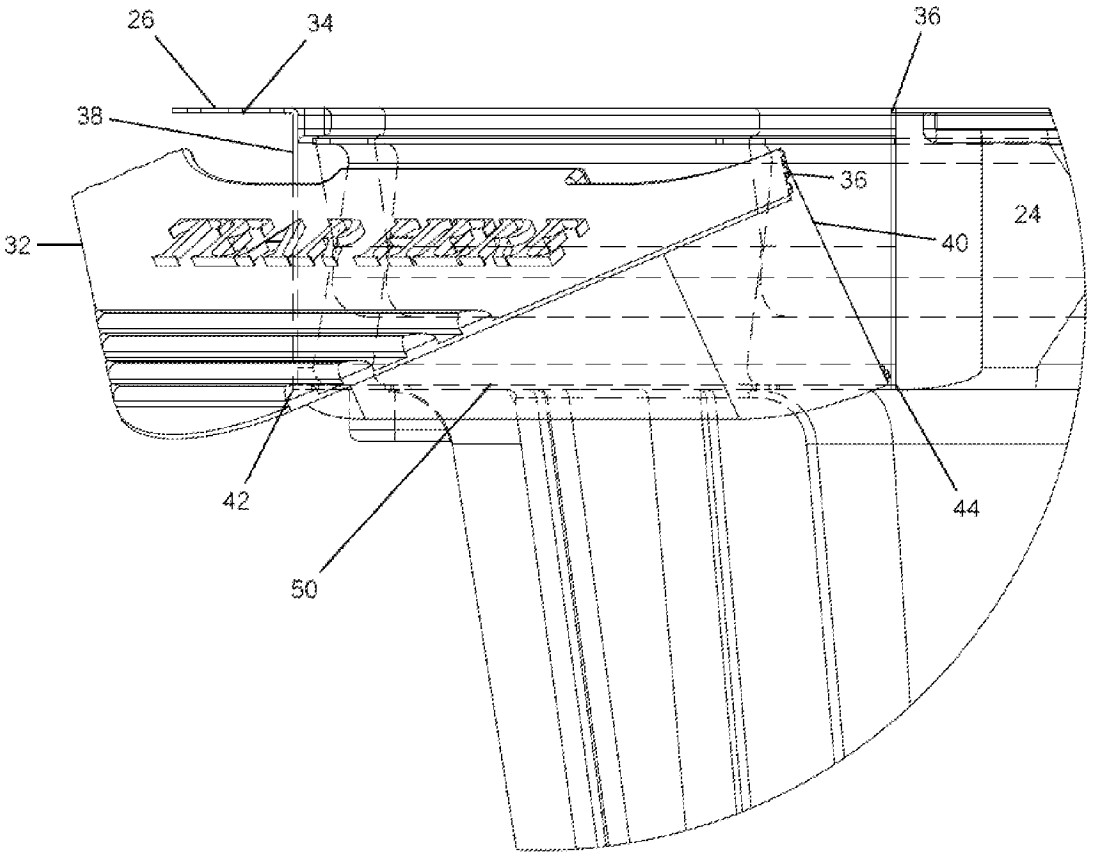

This provides a clear indication that novel structure 10 has been opened. It also facilitates subsequent closing and opening of container lid 14 as is perhaps best understood in connection with FIG. 3.

Figure 4:
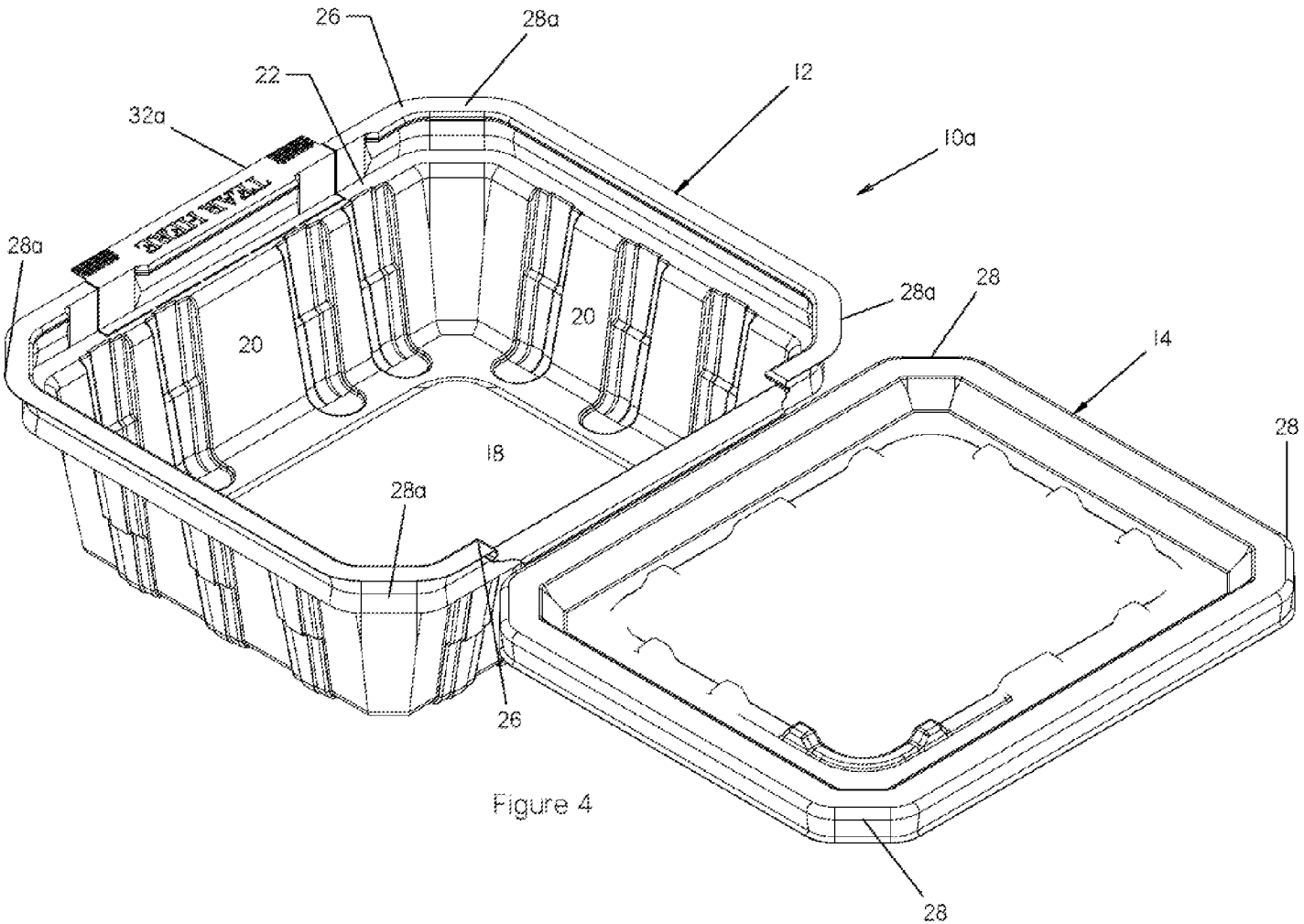
FIG. 4 is a perspective view of a second embodiment depicting the lid in an open configuration.
Figure 5:
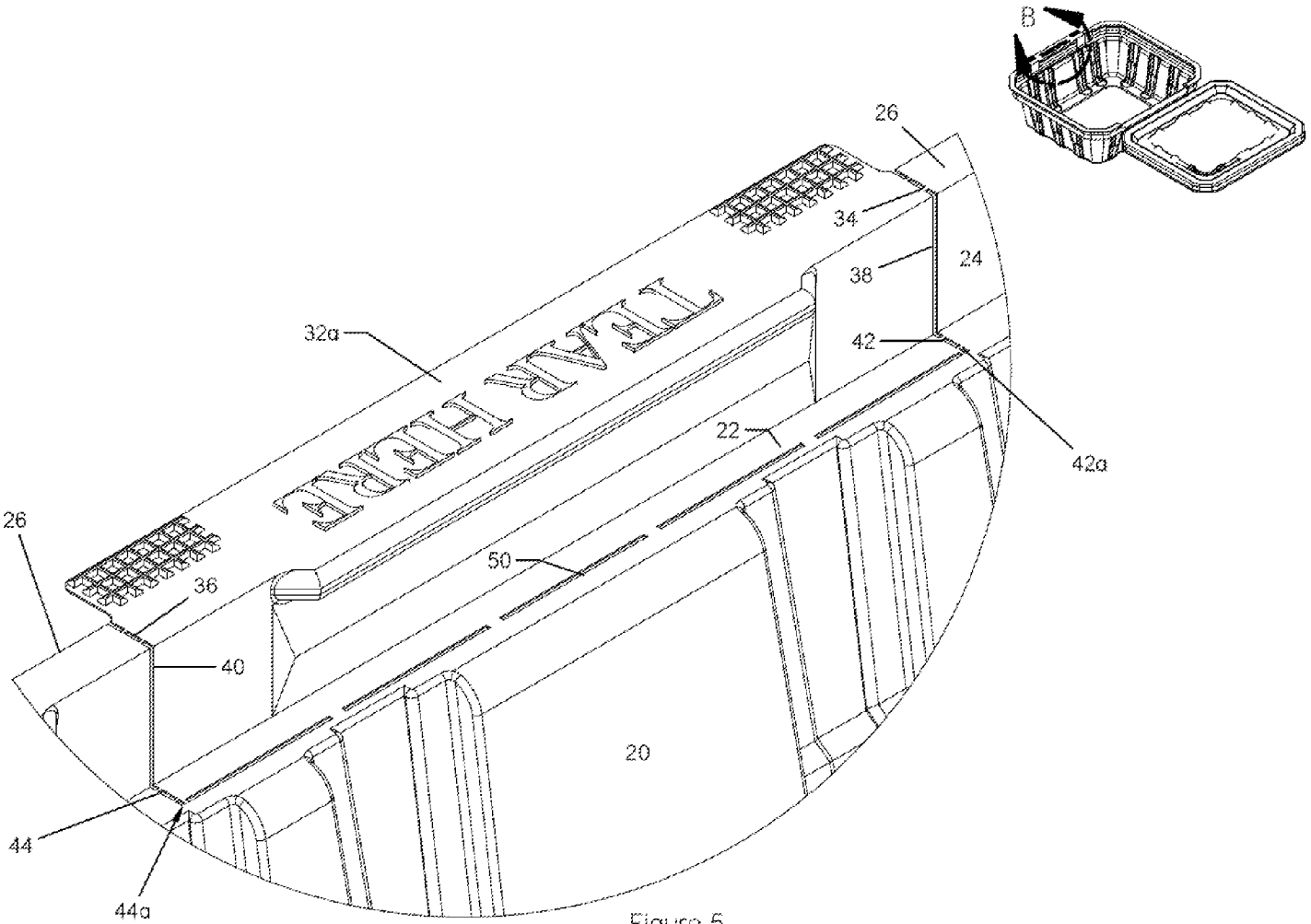
FIG. 5 is a detailed perspective view of the tear tab of the second embodiment with the lid being in an open configuration.
Figure 6:
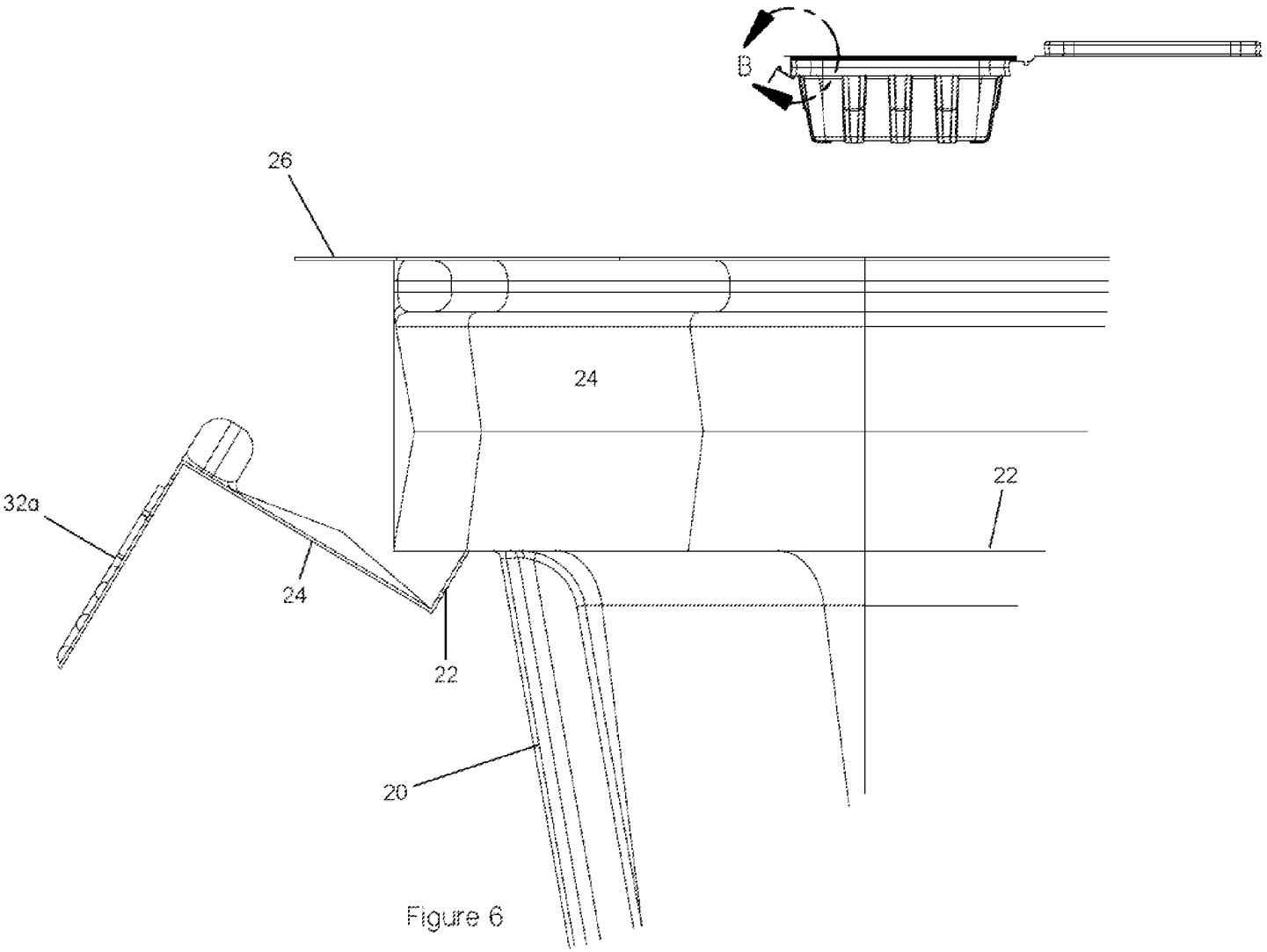
FIG. 6 is a side elevational view of the tear tab of the second embodiment after container opening.

The second embodiment is depicted in FIGS. 4-6 and is denoted 10*a* as a whole. This embodiment has essentially the same structure as the first embodiment as indicated by use of the same reference numerals to indicate the same or similar parts.

However, in this second embodiment, all of the corners of lid 12 and container 14 are beveled as at 28 and 28*a*, respectively, there being no ninety degree corner 32 in this second embodiment.

The tear tab in this embodiment is denoted 32*a*. Like tear tab 32 of the first embodiment, it is formed integrally with container 14 but the surface thereof that is coplanar with second flange 26 extends from said second flange 26 in a leading direction along a predetermined extent thereof so that it is easily seen and is adapted to be gripped by a user.

With the exception of arcuate perforation lines 46 and 48 of the first embodiment, which are not provided in this embodiment, and as best depicted in FIG. 5, the other lines 34, 36 (first and second straight perforation lines), 38, 40 (first and second straight clean cut lines), 42, 44 (third and fourth straight perforation lines) and straight perforation (or folding) line 50 of this embodiment are essentially the same as in the first embodiment because they are formed in the same structures as in the first embodiment. Accordingly, they are denoted with the same reference numerals in FIG. 5 so that the description of the first embodiment need not be repeated.

FIG. 6 is a side view depicting the structure after tear tab 32*a* has been separated from container 14.

Figure 7:
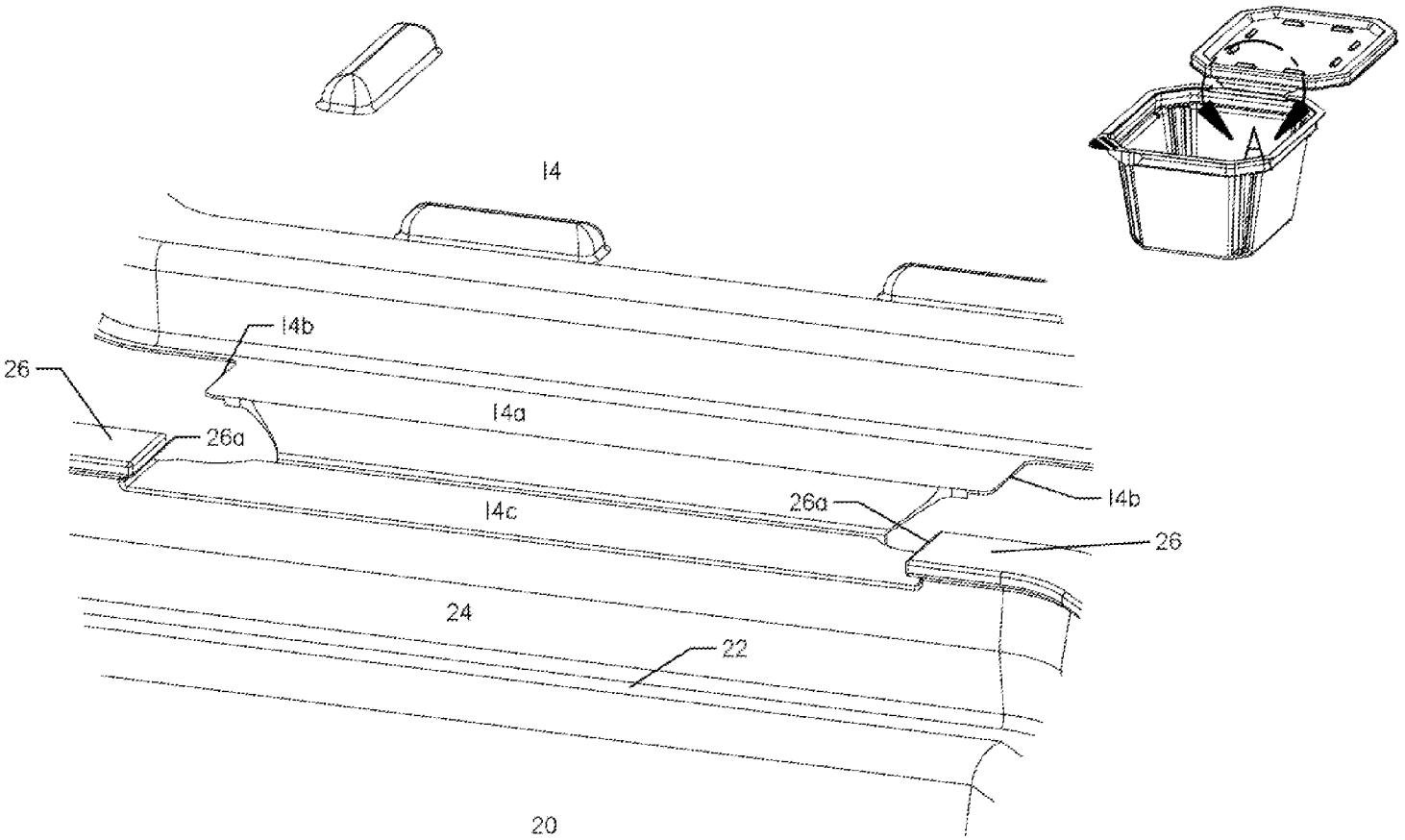
FIG. 7 is a detailed perspective view of the novel hinge structure, depicting the lid in an open configuration.

The novel hinge structure depicted in FIG. 7 is present in both embodiments of this invention.

Second flange 26 is discontinuous along its trailing end, creating a gap the opposite ends of which are denoted 26*a*, 26*a*. Hinge plate 14*a* is formed integrally with lid 14 and has an extent that slightly exceeds the distance between opposite ends 26*a*, 26*a*. Accordingly, to assemble lid 14 to container 12, hinge plate 14*a* is centered with respect to gap 26*a*, 26*a* and pressed thereinto so that opposite ends 14*b*, 14*b* of hinge plate 14*a* are transiently displaced as hinge plate 14*a* is pressed into the gap. Hinge plate 14*a* thus bends at its center due to its flexibility.

When the opposite ends 14*b*, 14*b* of hinge plate 14 enter the gap between opposite ends 26*a*, 26*a*, the resilience of the hinge plate causes the hinge plate to snap back into its flat configuration with opposite ends 14*b*, 14*b* positioned in underlying relation to the opposite ends 26*a*, 26*a* of the gap formed in second flange 26.

Shelf 14*c* supports hinge part 14*a* after opposite ends 14*b*, 14*b* of hinge part 14*a* have passed through gap 26*a*, 26*a* and entered into underlying relation to said opposite ends. This position is not depicted to avoid cluttering the drawings and is understood without the need for a drawing.

Accordingly, if tear tab 32 or 32*a* is not used to open container 10 or 10*a*, respectively, in the authorized, recommended way, and if an attempt is made to pry open the lid, opposite ends 14*b*, 14*b* of hinge plate 14*a* will pop out from under opposite ends 26*a*, 26*a* of the gap and lid 14 will separate from container 12. It will not be obvious to the pilferer how to re-attach the lid.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A tamper-evident package comprising:
a container comprising:
a bottom wall;
a sidewall projecting upwardly from said bottom wall to an uppermost end;
a cavity defined by said bottom wall and said sidewall;
a first flange extending outwardly from said cavity at said uppermost end, said first flange having a first longitudinal extent, an outer edge, and an inner edge;
a peripheral wall projecting upwardly from said first flange;
a second flange extending outwardly from said peripheral wall and parallel to said first flange, said second flange having a gap and a second longitudinal extent;
a removable tab projecting outwardly from said second flange, said tab defining:
a first perforation line transversing said second longitudinal extent on a first side of said tab;
a second perforation line transversing said second longitudinal extent opposite and parallel to said first perforation line on a second side of said tab;
a first clean cut line extending from an innermost end of said first perforation line, and extending between said second flange and said first flange;
a second clean cut line extending from an innermost end of said second perforation line, extending parallel to said first clean cut line between said second flange and said first flange;
a third straight perforation line formed in said first flange, extending from a first lowermost end of said first clean cut line, transversing said first longitudinal extent, and terminating at a first point between said outer edge and said inner edge;
a fourth straight perforation line formed in said first flange parallel to said third straight perforation line, extending from a second lowermost end of said second straight clean cut line, transversing said first longitudinal extent, and terminating at a second point between said outer edge and said inner edge; and,
a fifth perforation line formed in said first flange and extending between said first point and said second point;
a reclosable lid comprising:
a closed cover; and,
a flexible hinge resiliently seated within said gap and enabling said lid to pivot between:
a closed position;
an open position; and,
a reclosed position;
wherein properly removing said lid with lifting or depressing, said tab:
breaks said second flange along said first perforation line and said second straight perforation line;
separates said first wall and said second wall along said first straight clean cut line and said second straight clean cut line;
breaks said first flange along said third perforation line, said fourth straight perforation line, and said fifth straight perforation line;
detaches said tab from said container while maintaining said hinge of said lid resiliently seated within said gap of said container; and, thereby
allows said lid to pivot between said closed position, said open position, and said reclosed position; and,
wherein improperly removing said lid without lifting or depressing said tab:
unseats said hinge from said gap;
disconnects said lid from said container; and, thereby
prevents said lid from pivoting between said closed position, said open position, and said reclosed position.

2. The tamper-evident package of claim 1, wherein:
said gap of said container is slightly smaller than said hinge of said lid.

3. The tamper-evident package of claim 1, wherein:
said hinge of said lid is slightly larger than said gap of said container.

4. The tamper-evident package of claim 1, wherein:
said hinge of said lid is a plate formed from a flexible and resilient material capable of lying flat in repose and bowing in response to an external force.

5. A tamper-evident assembly comprising:
a container comprising:
a bottom wall;
a sidewall projecting upwardly from said bottom wall to an uppermost end;
a cavity defined by said bottom wall and said sidewall;
a first flange extending outwardly from said cavity at said uppermost end, said first flange having a first longitudinal extent, an outer edge, and an inner edge;
a peripheral wall projecting upwardly from said first flange;
a second flange extending outwardly from said peripheral wall and parallel to said first flange, said second flange having a gap and a second longitudinal extent;
a folding tab projecting outwardly from said second flange, said tab defining:
a first perforation line transversing said second longitudinal extent on a first side of said tab;

a second perforation line transversing said second longitudinal extent opposite and parallel to said first perforation line on a second side of said tab;

a first clean cut line extending from an innermost end of said first perforation line, and extending between said second flange and said first flange;

a second clean cut line extending from an innermost end of said second perforation line, extending parallel to said first clean cut line between said second flange and said first flange;

a third straight perforation line formed in said first flange, extending from a first lowermost end of said first clean cut line, transversing said first longitudinal extent, and terminating at a first point between said outer edge and said inner edge;

a fourth straight perforation line formed in said first flange parallel to said third straight perforation line, extending from a second lowermost end of said second straight clean cut line, transversing said first longitudinal extent, and terminating at a second point between said outer edge and said inner edge; and, a non-perforated folding line formed in said first flange and extending between said first point and said second point;

a hinged lid comprising:

a closed cover; and, a flexible hinge resiliently seated within said gap and enabling said lid to pivot between:

a closed position;

an open position; and, a reclosed position;

wherein properly removing said lid with lifting or depressing said tab:

breaks said second flange along said first perforation line and said second straight perforation line;

separates said first wall and said second wall along said first straight clean cut line and said second straight clean cut line;

breaks said first flange along said third perforation line and said fourth straight perforation line;

folds said first flange along said non-perforated straight folding line;

pivots said tab away from said container while maintaining said hinge of said lid resiliently seated within said gap of said container; and, thereby allows said lid to pivot between said closed position, said open position, and said reclosed position; and, wherein improperly removing said lid without lifting or depressing said tab:

unseats said hinge from said gap;

disconnects said lid from said container; and, thereby prevents said lid from pivoting between said closed position, said open position, and said reclosed position.

6. The tamper-evident assembly of claim 5, wherein:

said gap of said container is slightly smaller than said hinge of said lid.

7. The tamper-evident assembly of claim 5, wherein:

said hinge of said lid is slightly larger than said gap of said container.

8. The tamper-evident assembly of claim 5, wherein:

said hinge of said lid is a plate formed from a flexible and resilient material capable of lying flat in repose and bowing in response to an external force.

* * * * *